US005083554A

United States Patent [19]

Toso

[11] Patent Number: 5,083,554

[45] Date of Patent: Jan. 28, 1992

[54] DISPOSABLE BACK SUPPORT

[76] Inventor: Victor Toso, 842 - 22nd Ave., SE., Minneapolis, Minn. 55414

[21] Appl. No.: 568,704

[22] Filed: Aug. 17, 1990

[51] Int. Cl.[5] ..... A47C 20/00

[52] U.S. Cl. ..... 128/78; 5/432; 297/464

[58] Field of Search ..... 272/126, 135, 137; 5/432, 431, 443, 445; 128/60, 78; 297/464, 465, 126, 135, 137

[56] References Cited

U.S. PATENT DOCUMENTS

| | | | |
|---|---|---|---|
| 2,280,274 | 3/1942 | Wildermuth | 272/126 X |
| 3,295,517 | 1/1967 | Stevens | 128/78 |
| 3,850,167 | 11/1974 | Seeley | 128/87 R |
| 4,339,151 | 7/1982 | Riggs | 128/857 |
| 4,505,705 | 3/1985 | Matthews et al. | 604/385.1 |
| 4,759,754 | 7/1988 | Korpman | 604/387 |
| 4,773,106 | 9/1988 | Toso et al. | 128/78 X |
| 4,813,080 | 3/1989 | Toso | 128/78 |
| 4,934,005 | 7/1990 | Martin et al. | 5/431 |
| 5,001,791 | 3/1991 | Toso | 128/78 X |

*Primary Examiner*—Robert Bahr
*Assistant Examiner*—L. Thomas
*Attorney, Agent, or Firm*—N. J. Aquilino

[57] ABSTRACT

A back support device which supports the lower back of the user enabling the user to sit in an upright position for extended periods of time formed of a flexible back conforming support panel having elongated sleeves and a unitary strap threaded through the sleeves forming adjustable loops which engage the knees of a user to tension the support against the wearer's back.

9 Claims, 2 Drawing Sheets

DISPOSABLE BACK SUPPORT

BACKGROUND OF THE INVENTION

The present invention relates to a back support, and in particular to a disposable back support for supporting the lower back region of a person in a seated position.

As described in my previous U.S. Pat. No. 4,773,106, when an individual is seated upright on a flat surface without a back support, such position becomes uncomfortable due to the lack of support at the lumbar region. This is particularly true for people with poor posture and/or a weak back structure. For people who sit in upright positions for long periods of time, the back support disclosed in the aforementioned patent used a padded back support sized to fit the lumbar region of a user connected to a pair of inelastic straps which extend from the ends of the support and terminate in loops to engage the knees of the user. The pressure of the user's knees and legs pulls the support member against the lumbar region, thereby providing sufficient support to enable the user to sit in upright positions for extended periods.

THE INVENTION

The present invention relates to a disposable version of the back support shown in U.S. Pat. No. 4,773,106. Preferably, the support is made of a high grade, high strength paper similar to the types used with packaging materials, and is formed into a rectangular support panel formed with a pair of elongated longitudinal sleeves disposed in a side by side relationship and an elongated paper belt forming a pair of knee engaging loops and sized to fit within the support panel sleeves and to be adjustably movable therethrough to enable the user to loop the ends of the belt around his knees and support his back in the same manner as described with respect to the aforementioned U.S. Pat. No. 4,773,106. Because the support is made of relatively inexpensive material, it may be used a single time or a relatively small number of times and discarded. As with the aforementioned patented structure, at least one buckle is used to provide adjustability of the loops. Preferably, the loops are connected together which keeps the disposable support attached to the wearer's back when the wearer is standing, and which helps maintain the straps together when the wearer is seated in order to stabilize the knees of the user and maintain a more comfortable position.

Among the objects of the present invention are the provision of a back support which permits a user to sit upright in a comfortable position for an elongated period of time without the use of a rigid back support.

Another object is to provide a disposable lower back support device which may be used a minimum number of times and discarded.

Still another object is the provision of a back support device which is inexpensive to make, and which may readily be carried by a user until it is needed to support the back when seated in an upright position.

DESCRIPTION OF THE PREFERRED EMBODIMENTS

The drawings in FIGS. 1 to 5 illustrate a preferred first embodiment of the present invention.

A back support 10 is made of a high grade, high strength paper stock or plastic material which is inexpensive and is disposable after a single use or a limited number of uses.

Figure 1:
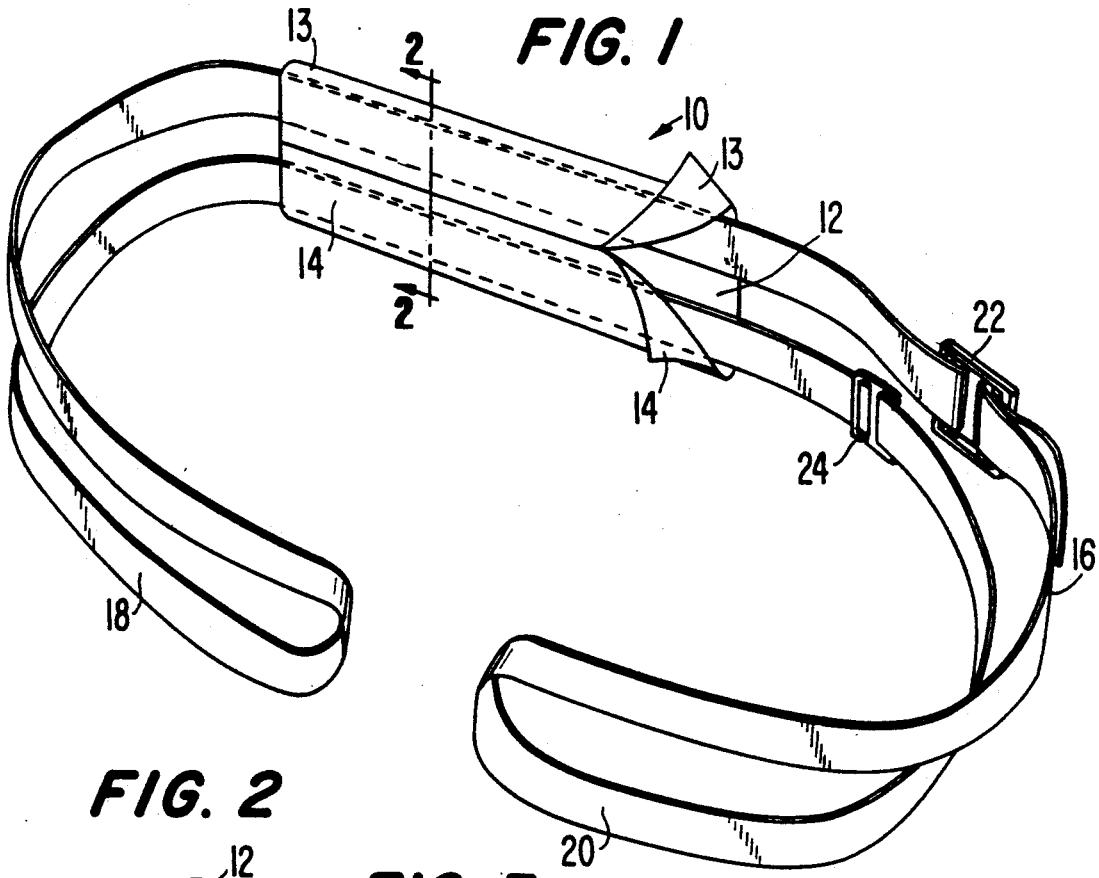
FIG. 1 is a perspective view of the back support in accordance with the present invention.
Figure 2:
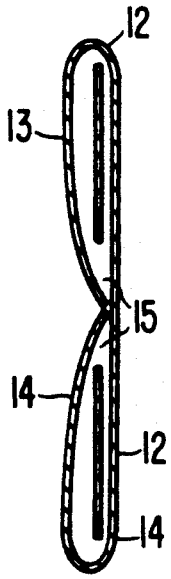
FIG. 2 is a sectional view taken along the lines 2—2 of FIG. 1.
Figure 3:
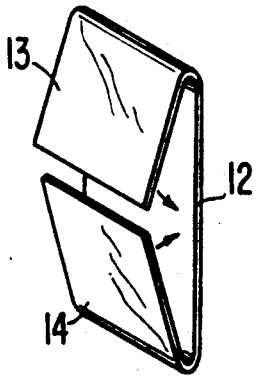
FIG. 3 is an end pespective view of a detail of the present invention of FIG. 1.
Figure 4:
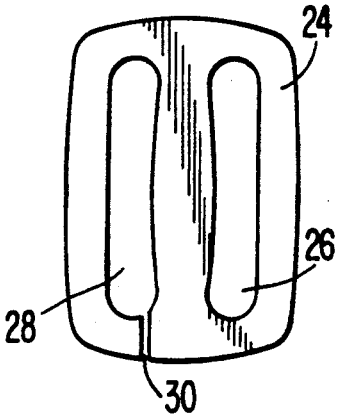
FIG. 4 is a view of another detail of the present invention.
Figure 5:
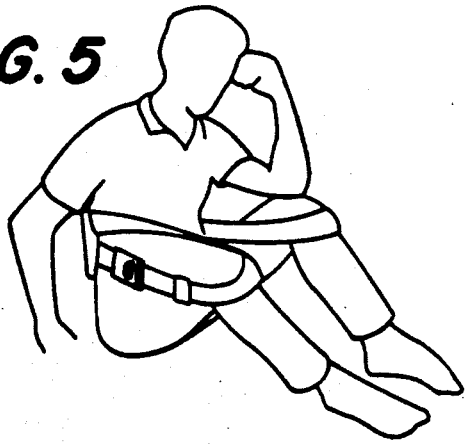
FIG. 5 is a view of a seated individual wearing the back support of the present invention.

The back support 10 is formed of a unitary, flexible, double ended, rectangular support panel 12 and integrally formed fold panels, 13 and 14 folded along the longitudinal edges of the support panel 12, as shown in FIG. 3, to form a pair of elongated sleeves 15, disposed in a side by side relationship and flattened in the plane of the rectangular member. The fold panels 13 and 14 are each folded toward the center of the support panel 12 and suitably secured along the medial edges thereof to form the sleeves 15. FIG. 1 shows the ends of the fold panels 13 and 14 folded away from the support panel 12 to further illustrate this construction A unitary strap member 16 is threaded through the sleeves forming a first loop 18 on one side of the rectangular support panel 12 and a second loop 20 on the opposite side of the rectangular support panel 12.

A buckle 22 is provided permanently fixed to one end of the strap member 16. The free end of the strap member 16 is threaded through the buckle 22 permitting adjustment of the length of the strap member 16 in accordance with the length of the free end of the strap member 16 inserted into the buckle.

The back support 10 needs only a single buckle 22 as long as there is at least one of the straps moveable freely through one of the elongated sleeves 14. Preferably, the portion of the strap nearest the buckle 22 is affixed to support panel 12 by tape or other suitable fastening material which prevents the buckle 22 from sliding out of place during the adjustment. As long as one of the straps is allowed to slide freely, a second adjustment buckle is not required.

A clip 24 is movably attached to the strap 16 by passing the strap 16 through a first opening 26 in the clip. A second opening 28 in the clip 24 includes a slit 30 to provide access for the strap 16 to the second opening 28 as described hereinbelow.

The back support 10 functions as follows. When the user is seated in a position which requires an upright posture without a permanent back support, the rectangular support panel 12 of the back support 10 is placed against the lumbar portion of the back. The first and second loops 18 and 20 are placed about the knees of the user and the length of the strap 14 may be adjusted to provide a proper fit. The force of the user's knees against the loops 18 and 20 pulls the rectangular support panel 12 of the back support 10 against the back of the user, thereby supporting the user's back and allowing the user to remain in an upright seated position for long periods of time.

In order to stabilize the knees of the user, the clip 24, which is attached to one of the leg loops, is connected to the opposite loop by sliding it through the slit 30 into the second opening 28. This holds the loops 18 and 20 together, thereby keeping the user's knees in a more comfortable position.

Figure 6:
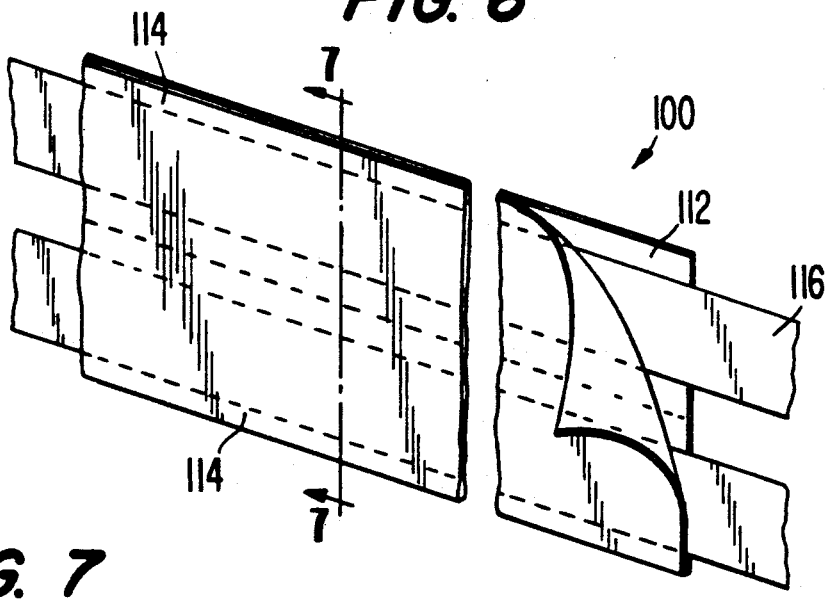
FIG. 6 is a partial view of a second embodiment of the present invention.
Figure 7:
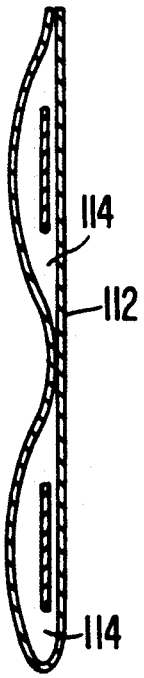
FIG. 7 is a sectional view taken along the lines 7—7 of FIG. 6.
Figure 8:
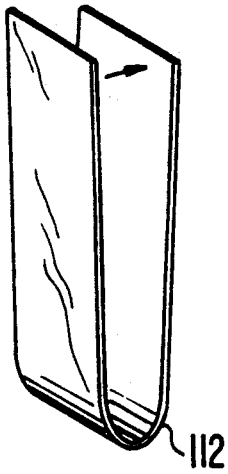
FIG. 8 is an end perspective view of a detail of FIG. 6.
Figure 9:
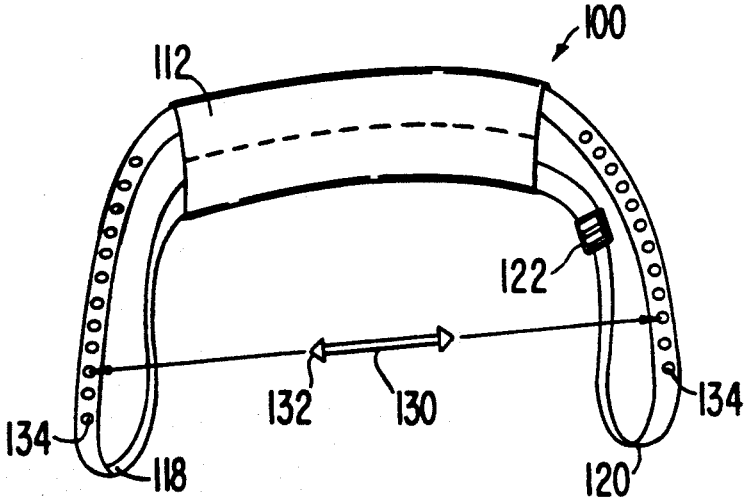
FIG. 9 is a perspective view of the back support of the present invention showing the loop attachment means.

A second embodiment of a back support 100 is shown in FIG. 6. In this embodiment, a rectangular support panel 112 is formed with an integral fold panel 113 folded from one longitudinal edge of the rectangular support panel 112, as shown in FIG. 8, and fastened approximately midway and on the opposite longitudinal edge to create a pair of elongated sleeves 114. A unitary strap formed into loops 118 and 120 and an adjustable buckle 122 are structured and used in the same way as described hereinabove with respect to the first embodiment.

A connector band 130, which is preferably elasticized, is connected between the loops 118 and 120. The connector band 130 aids in keeping the loops together to stabilize the knees of the user when the support is worn in the same manner an described hereinabove. The connector band 130 is formed with hooks 132 on each end which cooperate with openings 134 periodically spaced along the loops 118 and 120.

It will be appreciated that modifications may be made to the invention in keeping within the scope of the following claims.

I claim:

1. A support device for supporting the lower back region of a user in a seated position comprising:

a double ended, flexible, rectangular, planar, back support panel having a length substantially spanning the width of the lower back of user and width substantially spanning the height of the lumbar portion the user; said support and panel including integrally formed, elongated sleeves extending between ends of said double ended panel in a generally longitudinal direction therewith and forming elongated openings; an elongated strap threaded through the openings formed by said elongated sleeves; said strap extending beyond said ends of said panel and forming strap loops; said loops being of such a length to engage the knees of a user in a seated position whereby the force of the said users knees on said strap loops pulls said panel against the lower back of the user.

2. The support device of claim 1 wherein said sleeves are formed of a first portion of said panel folded along one longitudinal edge thereof to approximately midway of the width of said support panel and a second portion of said panel folded from an opposite longitudinal edge of said support panel approximately midway of the width of said support panel.

3. The support device of claim 1 wherein said sleeves are formed of a single fold from a longitudinal edge of said support panel folded to and attached adjacent an opposite longitudinal edge of said support panel and further attached midway between said edges in a longitudinal direction thereby forming said openings between said fold and said panel.

4. The support of the device of claim 1 wherein said support panel and said straps are made of paper stock material.

5. The support of the device of claim 1 wherein said support panel and said straps are made of plastic material.

6. The support device of claim 1 wherein said elongated strap includes ends and a buckle attached to one of said ends permitting adjustment of the length of said strap loops to accommodate various size users.

7. The support device of claim 1 further including means to connect said straps together when said support device is in use to stabilize the knees of the user.

8. The support device of claim 7 wherein said means to connect said straps is a buckle.

9. The support device of claim 7 wherein said means to connect said straps is an elasticized band.

* * * * *